US009919867B1

(12) United States Patent
Poncsak

(10) Patent No.: US 9,919,867 B1
(45) Date of Patent: Mar. 20, 2018

(54) AUTOMATIC BIN LID OPENER SYSTEM

(71) Applicant: Shawn Poncsak, Brandon (CA)

(72) Inventor: Shawn Poncsak, Brandon (CA)

( * ) Notice: Subject to any disclaimer, the term of this patent is extended or adjusted under 35 U.S.C. 154(b) by 0 days.

(21) Appl. No.: 15/045,633

(22) Filed: Feb. 17, 2016

(51) Int. Cl.
*B65D 90/66* (2006.01)
*B65D 90/62* (2006.01)

(52) U.S. Cl.
CPC ..... *B65D 90/66* (2013.01); *B65D 90/62* (2013.01)

(58) Field of Classification Search
CPC ..... B65D 90/62; B65D 90/66
USPC ..... 49/357
See application file for complete search history.

(56) References Cited

U.S. PATENT DOCUMENTS 4,208,839 A 6/1980 Candy, Sr.
4,327,522 A 5/1982 Meadows
4,598,496 A * 7/1986 Van Daele ..... B65D 90/623 49/343
4,625,888 A * 12/1986 Thompson ..... B65D 90/623 220/262
4,747,244 A * 5/1988 Christianson ..... B65D 90/10 220/262
5,218,784 A 6/1993 Pollock
5,586,678 A * 12/1996 Rosch ..... B65D 90/10 220/262
8,196,362 B1 * 6/2012 Ratts ..... E05F 11/04 49/357
8,375,637 B2 * 2/2013 Zazula ..... E05F 11/04 49/357
2011/0024418 A1 * 2/2011 Batson ..... B65D 90/585 220/211

* cited by examiner

*Primary Examiner* — Jerry Redman

(57) ABSTRACT

An automatic bin lid opener system is an apparatus used for opening and closing the top hatch of a storage bin from a control box at ground level to allow the user to avoid climbing ladders to the top of the storage bin. The control box may be operated manually or may be programmed to operate automatically as preferred by the user. The programmable control box may also be operated remotely at great distances via a cell phone using a cell phone application.

20 Claims, 5 Drawing Sheets

AUTOMATIC BIN LID OPENER SYSTEM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of lids for bins and more specifically relates to an automatic bin lid opener system.

2. Description of the Related Art

Various grains and dry materials are produced and used extensively in the agricultural business. These materials are produced and stored in volume, usually in silos or bins. Most often, there are multiple storage bins in operation on the average sized farm. The dry material that is usually stored in these bins dictates the design for the bins, which generally has a cylindrical sidewall with a conical shaped bottom that funnels the dry material, such as grain, to a bottom opening. The bottom opening has some type of hatch or closing device. To put the material in the bin, there is a top lid that is opened, which may be used also for introduction of air for aeration of the stored material. When a bin needs to be opened, a farmer or farm hand has to climb a ladder to the top of the bin and remove the bin lid. The task of climbing to the top of these bins can be dangerous, and at the very least, time consuming and laborious. These bins can be thirty feet, forty feet, or higher. These bin lids have been opened this way for as long as there have been bins. The labor and the safety factor are becoming increasingly more of a problem as the age of farmers increase with time. Fewer farmers are entering the field at a young age choosing rather to enter other fields that require less hours and labor. A solution is needed to add convenience, reduce labor, and increase safety when opening bin lids.

Various attempts have been made to solve the above-mentioned problems such as those found in U.S. Pat. No. 5,218,784 to Eugene B. Pollock, U.S. Pat. No. 4,208,839 to James O. Candy, Sr., and U.S. Pat. No. 4,327,522 to William W. Meadows. This art is representative of remote grain bin lid openers. None of the above inventions and patents, taken either singly or in combination, is seen to describe the invention as claimed.

Ideally, a remote grain bin lid opener should provide a reduction of labor for the user and be programmable to operate according to pre-programmed settings, while optionally being operable from remote locations via a cell phone, and yet, would operate reliably and be manufactured at a modest expense. Thus, a need exists for a reliable automatic bin lid opener system to avoid the above-mentioned problems.

BRIEF SUMMARY OF THE INVENTION

In view of the foregoing disadvantages inherent in the known remote grain bin lid opener art, the present invention provides a novel automatic bin lid opener system. The general purpose of the present invention, which will be described subsequently in greater detail, is to provide a reduction of labor for the user and programmability to operate according to pre-programmed settings, while optionally being operable from remote locations via a cell phone.

The bin top closure is useful for remotely opening and closing the top of a storage bin for either filling the storage bin with a material to be stored or for aerating the material as needed that is placed therein by opening or closing the second lid portion. The lid second portion may be placed and held at any degree of opening between fully open and fully closed depending on the amount of aeration required. The automatic bin lid opener system preferably comprises a bin top closure having a lid first portion, a lid second portion, and a hinge, a bin lid operator having an actuator, a telescopic cylinder having a first and a second end, a swivel joint, a bail, and a programmable control box.

The lid first portion may be non-removably attached to the top opening of a storage bin and the lid second portion is pivotally attached to the lid first portion on one side via the hinge such that when the lid second portion is not in a parallel relationship with the lid first portion, an inner volume of the storage bin is able to be accessed, and when the lid second portion is in a parallel relationship with the lid first portion, the inner volume is sealed from the exterior environment.

The bin lid operator is able to be attached to an existing storage bin lid in which case, the lid first portion and the lid second portion would be existing equipment and then only the telescopic cylinder, the bail, and the swivel joint would be attached to the existing equipment. The first end of the telescopic cylinder is attached to the swivel joint and the swivel joint is attached to the top exterior surface of the storage bin. The first end of the telescopic cylinder is then attached to the swivel joint and the second end is attached to the bail which is attached to the lid second portion in a way that provides proper leverage and angle of movement for the telescopic cylinder to open or close the lid second portion. The bail is angled at about a right angle to the lid second portion in line with the hinge allowing the bin lid operator to pivotally open and close the lid second portion at an advantageous angle of pull, and to be operated using the control box from a remote location such as from the ground level. The swivel joint is adapted to freely rotate in 4 directions to compensate for misalignment.

The bin lid operator is also structured to be easily adapted to slide open the lid second portion if used on the bottom of the storage bin such that it operates like a slide valve for opening and closing the bin to empty the contents therein. The bin lid operator is able to apply approximately 200 pounds of closing force to ensure sealing of the top of the tank or to slide the lid second portion and to slide valve against the weight of the contents against it. Most bins have a conically shaped bottom for funneling the material downward to the closure at the bottom of the bin, and the weight of the contents tends to press against the inside of the slide valve. When using the automatic bin lid opener system for a slide valve opener and closer, the bail, the lid first portion, or the lid second portion may not need to be used.

The telescopic cylinder is adapted to have approximately 6 attachment points for adjusting the length of the cylinder to allow for a 90 degree opening of the lid second portion. The actuator is attached to the telescopic cylinder so that the telescopic cylinder is able to pivot the lid second portion when the actuator is powered and receives an open or a close command from the programmable control box. The actuator is adapted to extend about 8 inches from a fully retracted position to allow for pivotally operating the lid second portion throughout an approximate 90 degree range of movement. The programmable control box, which preferably is located near ground level, is in communication with the actuator so that the lid second portion may be pivoted to open, close, or be held at any angle in between for aeration.

The programmable control box of the bin top closure is able to operate at least one bin lid operator but may be adapted to operate up to six bin lid operators either simultaneously or independently. When certain types of dry materials are being stored, such as grain, humidity or the lack thereof may be a consideration with regard to how the automatic operation of the system is programmed. Programmable logic controllers may be used in the programmable control box that may have digital and analog inputs for receiving condition signals, such as from a humidity sensor within the storage bin, so that the lid second portion can be automatically opened at a desired angle for aeration as determined by the analog signal value received which corresponds to a predetermined degree of opening as programmed by the user. The programmable control box may comprise a programmable time delay function for purposes requiring a delay in opening or closing. The programmable control box may be operated manually by a manual bin lid operator switch to bypass automatic operation. In simple usage, a toggle switch located exteriorly on the front of the programmable control box can disconnect power to the bin lid operator to stop movement of the lid second portion manually at a user preferred angle.

The programmable control box is preferably adapted to be operated remotely with an Android® cell phone via a cell phone application (APP). The APP that may be installed on Android® cell phones preferably provides for multiple parameter settings which allows not only the remote operation of the automatic bin lid opener system, but for resetting programmed set points. The Android® Cell Phone APP may be configured to receive a signal to notify the cell phone user of a loss of power at the storage bin site and/or a loss of WiFi signal. Locally, the programmable control box may have a plurality of exterior status indicators for indicating the presence of power and the presence or loss of wireless fidelity.

A convenient feature of the programmable control box is the ease of installation. The bottom of the programmable control box may have a plurality of power and/or control cables extending through the bottom of the box that are between about 6 inches to 2 feet in length, each having an electrical coupler such as a power quick connect, a twist lock, or a cord cap or any combination thereof for coupling to a cable or electrical cord that corresponds to a bin lid operator. Each cable extending through the bottom of the box is in communication with the power output of a corresponding circuit output from the control unit. In some circumstances, it may be desirable to employ a closed circuit T.V. camera with the existing WiFi at the site for visually operating the system from considerable distances.

The present invention holds significant improvements and serves as an automatic bin lid opener system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, automatic bin lid opener system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a remote grain bin lid opener and more particularly to a automatic bin lid opener system as used to reduce labor for the user and be programmable to operate according to pre-programmed settings, while optionally being operable from remote locations via a cell phone.

Generally speaking, the automatic bin lid opener system is an apparatus used for opening and closing the top hatch of a storage bin from a control box near ground level to allow the user to avoid climbing ladders to the top of the storage bin. The control box may be operated manually or may be programmed to operate automatically as preferred by the user. The programmable control box may also be operated remotely at great distances via a cell phone using a cell phone application.

Figure 1:
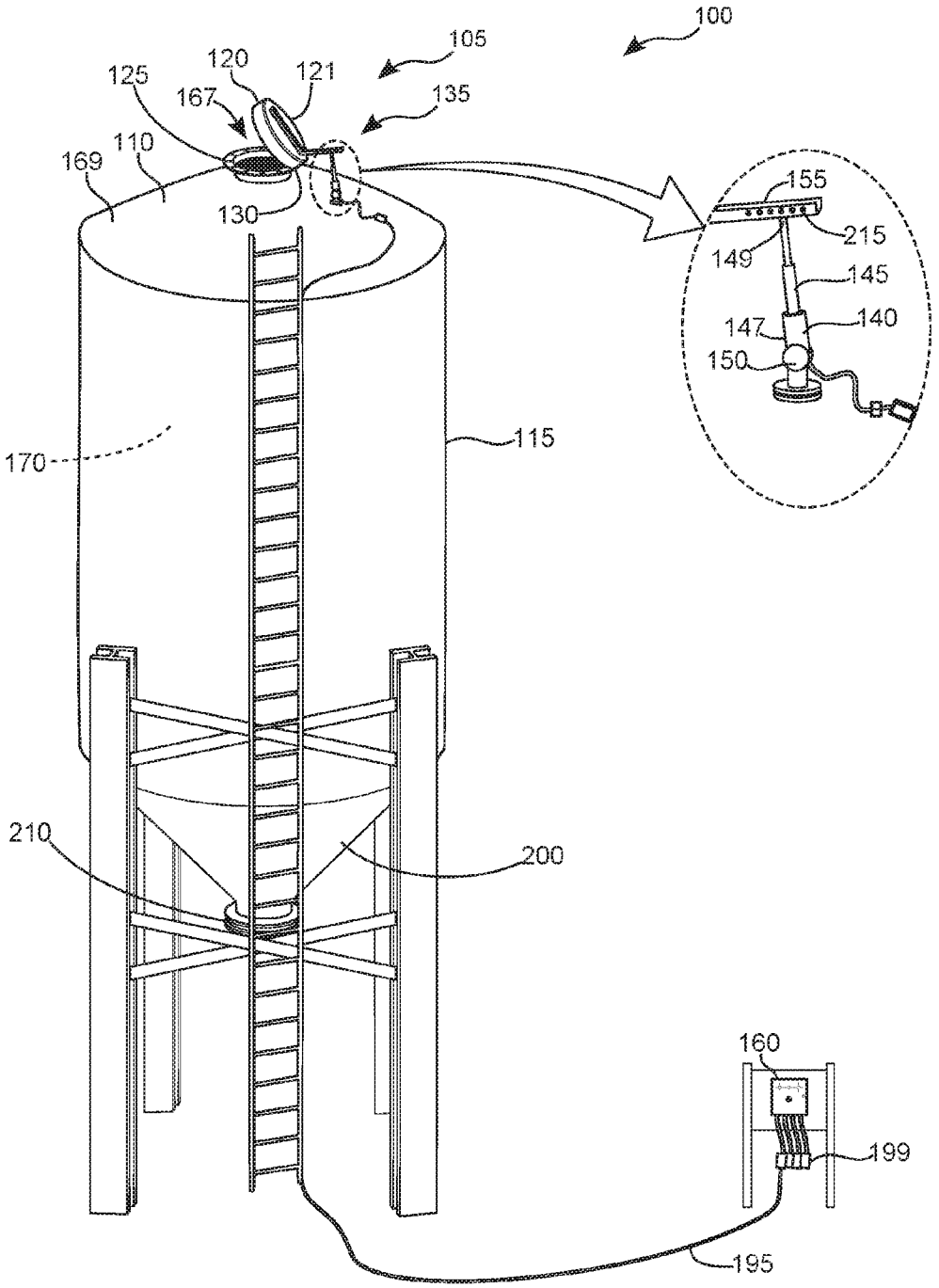
FIG. 1 shows a perspective view illustrating an automatic bin lid opener system according to an embodiment of the present invention.

Referring to the drawings by numerals of reference there is shown in FIG. 1, a perspective view illustrating automatic bin lid opener system 100 according to an embodiment of the present invention.

Bin top closure 105 is useful for remotely opening and closing top 110 of a storage bin 115 for either filling storage bin 115 with a material to be stored or for aerating the material, as needed, that is placed therein by opening or closing lid second portion 120. Lid second portion 120 may be placed and held at any degree of opening between fully open and fully closed depending on the amount of aeration required.

Automatic bin lid opener system 100 preferably comprises bin top closure 105 having lid first portion 125, lid second portion 120, and hinge 130, bin lid operator 135 having actuator 140, telescopic cylinder 145 having first end 147 and second end 149, swivel joint 150, bail 155, and programmable control box 160.

Lid first portion 125 may be non-removably attached to top opening 167 of storage bin 115 and lid second portion 120 is pivotally attached to lid first portion 125 on one side via hinge 130 such that when lid second portion 120 is not in a parallel relationship with lid first portion 125, inner volume 170 of storage bin 115 is able to be accessed, and when lid second portion 120 is in a parallel relationship with lid first portion 125, inner volume 170 is sealed from the exterior environment.

Figure 2:
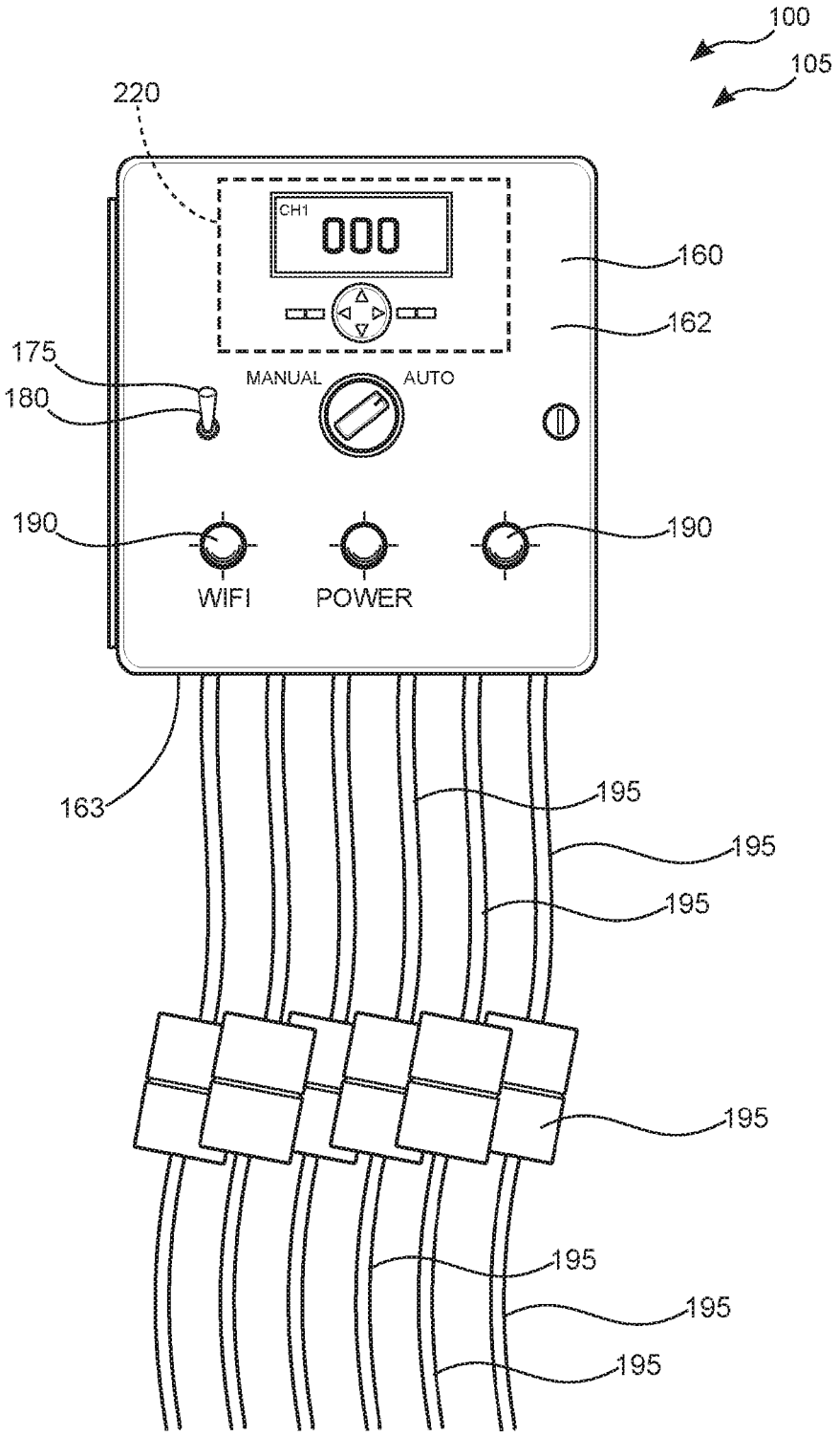
FIG. 2 is a front elevation view illustrating a programmable control box of the automatic bin lid opener system according to an embodiment of the present invention of FIG. 1.

Referring now to FIG. 2, is a front elevation view illustrating programmable control box 160 of automatic bin lid opener system 100 according to an embodiment of the present invention of FIG. 1.

Programmable control box 160, which preferably is located near ground level, is in communication with actuator 140 so that lid second portion 120 may be pivoted to open, close, or be held at any angle in between for aeration of the stored material within storage bin 115. The stored material typically might be grain or fertilizer or other such material that requires storage within a particular range of humidity, and the degree of opening of lid second portion 120 may help facilitate achieving the desired atmosphere.

Programmable control box 160 of bin top closure 105 is able to operate at least one bin lid operator 135 but may be adapted to operate up to six bin lid operators 135 either simultaneously or independently. When certain types of dry materials are being stored, such as grain, humidity or the lack thereof may be a significant consideration with regard to how the automatic operation of automatic bin lid opener system 100 is programmed Programmable logic controllers 220 (PLC's) may be used in programmable control box 160 that may have digital and analog inputs for receiving condition signals, such as from a humidity sensor placed within storage bin 115, so that lid second portion 120 can be automatically opened at a desired angle for aeration as determined by the analog signal value received which corresponds to a predetermined degree of opening as programmed by the user. Programmable control box 160 may comprise a programmable time delay function for purposes requiring a delay in opening or closing of lid second portion 120. Programmable control box 160 may be operated manually by manual bin lid operator switch 175 to bypass automatic operation. In simple usage, toggle switch 180 located exteriorly on front 162 of programmable control box 160 can disconnect power to bin lid operator 135 to stop movement of lid second portion 120 manually at a user preferred angle.

Programmable control box 160 is preferably adapted to be operated remotely with Android® cell phone 185 via a cell phone application (APP). The APP that may be installed on Android® cell phones 185 preferably provides for multiple parameter settings which allows not only the remote operation of automatic bin lid opener system 100, but for resetting programmed set points or bypassing automatic mode. Android® cell phone 185 APP may be configured to receive a signal to notify Android® cell phone 185 user of a loss of power at storage bin 115 site and/or a loss of WIFI signal. Locally, programmable control box 160 may have a plurality of exterior status indicators 190 for indicating the presence of power and the presence or loss of wireless fidelity.

A convenient feature of programmable control box 160 is the ease of installation. The bottom of programmable control box 160 may have a plurality of power/control cables 195 extending through bottom 163 of programmable control box 160 that are between about 6 inches to about 2 feet in length, each having electrical coupler 199 such as a power quick connect, a twist lock, or a cord cap or any combination thereof for coupling to power/control cable 195 that corresponds to each bin lid operator 135 included in automatic bin lid opener system 100. Each power/control cable 195 extending through bottom 163 of programmable control box 160 is in communication with the power output of a corresponding circuit output from programmable control box 160. In some circumstances, it may be desirable to employ a closed circuit T.V. camera with the existing WIFI at the site for visually operating system 100 from considerable distances.

Figure 3:
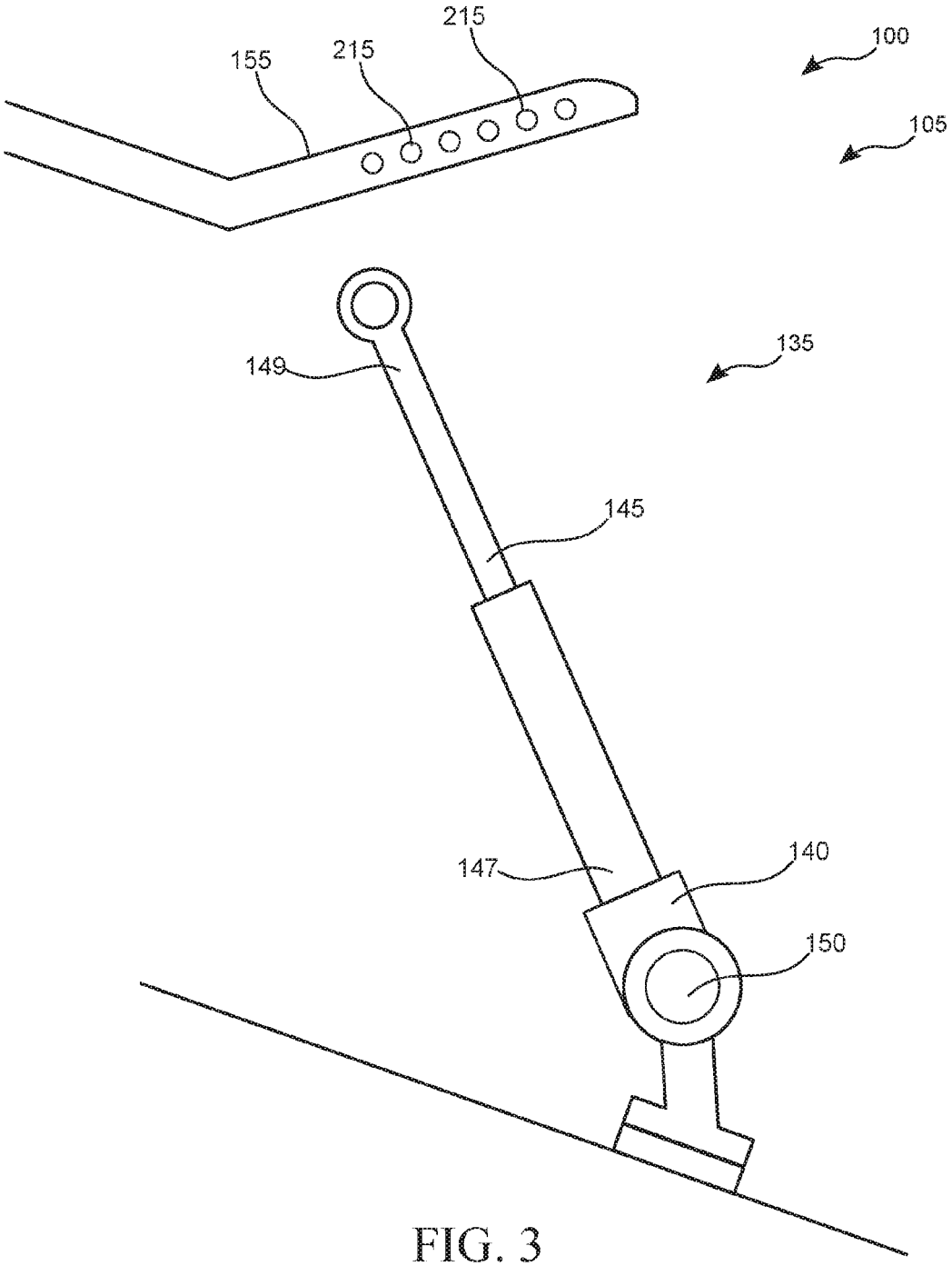
FIG. 3 is a perspective view illustrating a bin lid operator of the automatic bin lid opener system according to an embodiment of the present invention of FIG. 1.

Referring now to FIG. 3, is a perspective view illustrating bin lid operator 135 of automatic bin lid opener system 100 according to an embodiment of the present invention of FIG. 1.

Bin lid operator 135 is able to be attached to an existing storage bin lid 121 in which case, lid first portion 125 and lid second portion 120 would be existing equipment and then only telescopic cylinder 145, bail 155, and swivel joint 150 would be attached to the existing equipment. First end 147 of telescopic cylinder 145 is attached to swivel joint 150 and swivel joint 150 is attached to top exterior surface 169 of storage bin 115. First end 147 of telescopic cylinder 145 is then attached to swivel joint 150 and second end 149 is attached to bail 155 which is attached to lid second portion 120 in a way that provides proper leverage and angle of movement for telescopic cylinder 145 to open or close lid second portion 120. Bail 155 is angled at about a right angle to lid second portion 120 in line with hinge 130 allowing bin lid operator 135 to pivotally open and close lid second portion 120 at an advantageous angle of pull, and to be operated using programmable control box 160 from a remote location such as from the ground level. Swivel joint 150 is adapted to freely rotate in 4 directions to compensate for misalignment.

Bin lid operator 135 is also structured to be easily adapted to slide open lid second portion 120 if used on the bottom of storage bin 115 such that it operates like slide valve 210 for opening and closing storage bin 115 to empty the contents therein. Bin lid operator 135 is able to apply approximately 200 pounds of closing force to ensure sealing of top opening 167 of storage bin 115 or to slide lid second portion 120 against the weight of the contents against it. Most storage bins 115 used in agriculture have conically shaped bottoms 200 for funneling the material downward to closure 205 at the bottom of storage bin 115, and the weight of the contents tends to press against the inside of slide valve 210. When using automatic bin lid opener system 100 for slide valve 210 opener and closer, bail 155, lid first portion 125, or lid second portion 120 may not need to be used, most generally on existing equipment.

Telescopic cylinder 145 is adapted to have approximately 6 attachment points 215 for adjusting the length of telescopic cylinder 145 to allow for a 90 degree opening of lid second portion 120. Actuator 140 is attached to telescopic cylinder 145 so that telescopic cylinder 145 is able to pivot lid second portion 120 when actuator 140 is powered and receives an open or a close command from programmable control box 160. Actuator 140 is adapted to extend about 8 inches from a fully retracted position to allow for pivotally operating lid second portion 120 throughout an approximate 90 degree range of movement.

Figure 4:
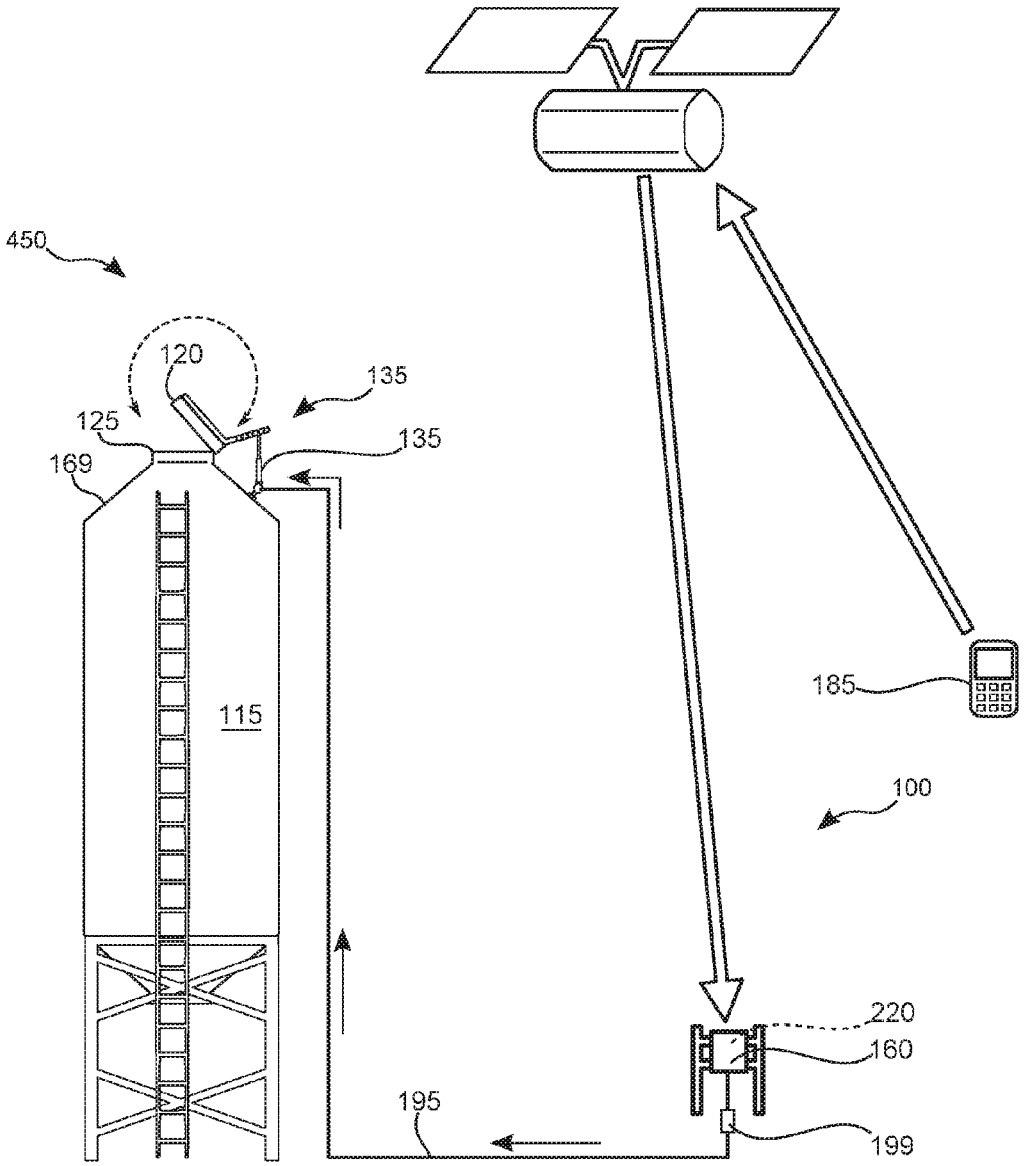
FIG. 4 is a diagram illustrating the automatic bin lid opener system according to an embodiment of the present invention of FIG. 1.

Referring now to FIG. 4, showing a diagram illustrating automatic bin lid opener system 100 according to an embodiment of the present invention of FIG. 1.

This figure illustrates the physical relationship between the main components of automatic bin lid opener system 100 as well as control and command paths that may typically be used. For Android® cell phone 185 control, an application compatible with Android® cell phones 185 may be needed that may provide a plurality of control functions. These functions may be enhanced if a CCTV camera is used in conjunction with system 100 that can provide remote viewing to save travel time and increase efficiency. In this figure, programmable control box 160 is located close to ground level with power/control cable 195 extending to top exterior surface 169 of storage bin 115 for operation of bin lid operator 135 for each storage bin 115. In addition, Android® cell phone 185 is depicted controlling the programmable control box 160 through a satellite relay, with Android® cell phone 185 user at any location where Android® cell phone 185 reception is received. Operating automatic bin lid opener system 100 by Android® cell phone 185 preferably temporarily bypasses a pre-programmed automatic operation which may resume when the next input condition is received. Automatic mode may be divided into various programs for operation which may be useful for varying conditions such as different seasons, different weather patterns, or different time periods. For instance, program one may be a simplified automatic method of operation which may allow use of a time delay or time clock operation which corresponds to a user defined degree of opening of lid second portion 120 while mode two may accommodate multiple settings for daily operation of either one bin lid operator 135 or one setting for multiple bin lid operators 135. Program three may allow multiple settings for multiple bin lid operators 135, and yet a program four may allow for continuous operation through the receiving of various analog input signals such as from humidity detectors, temperature detectors, or the like, in which case the controller 220 sends an output signal(s) to adjust lid second portion(s) 120 to a predetermined angle, or either completely closed or completely open, as determined by the user.

Automatic bin lid opener system 100 may be sold as kit 450 comprising the following parts: at least one bin lid operator 135; at least one programmable control box 160; at least one power/control cable 195 having electrical couplers 199 for each power/control cable 195 supplied; at least one lid first portion 125; at least one lid second portion 120; at least one hinge 130; and at least one set of user instructions. The kit has instructions such that functional relationships are detailed in relation to the structure of the invention (such that the invention can be used, maintained, or the like in a preferred manner). Automatic bin lid opener system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Those with ordinary skill in the art will now appreciate that upon reading this specification and by their understanding the art of remote storage bin lid openers as described herein, methods of 500 and 600 will be understood by those knowledgeable in such art.

Figure 5:
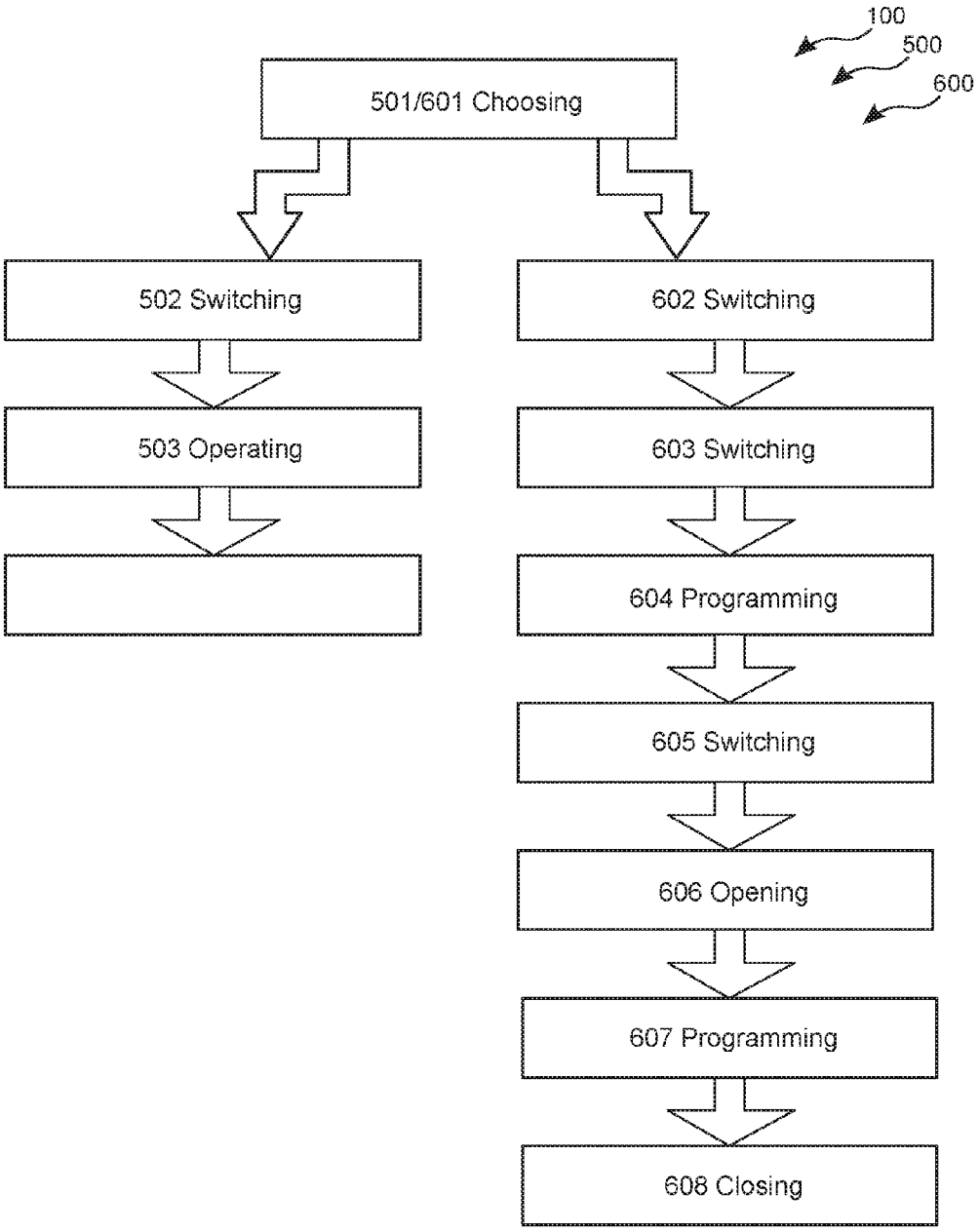
FIG. 5 is a flowchart illustrating a method of use for automatic bin lid opener system according to an embodiment of the present invention of FIGS. 1-4.

Referring now to FIG. 5, showing method of use 500 for automatic bin lid opener system 100. A method of using automatic bin lid opener system 100 may comprise the steps of step one 501 choosing either manual mode or automatic mode for operation. If choosing manual mode of operation: step two 502 switching selector switch to manual mode; step three 503 operating toggle switch to adjust lid second portion to the desired angle, or to fully open or fully closed. If choosing automatic mode of operation: step two 602 switching selector switch to automatic mode of operation; step three 603 switching controller 220 to program mode; step four 604 programming desired operation of lid second portion 120 adjustments to correspond with the number of user defined conditions expected to be encountered; step five 605 switching controller 220 to run mode; step six 606 opening automatic bin lid opener system 100 control APP on Android® cell phone 185; step seven 607 programming desired settings; step eight 608 closing Android® cell phone 185 APP.

It should be noted that steps 502, 503, and 602-608 are optional steps and may not be implemented in all cases. Optional steps of method 500 and 600 are illustrated using dotted lines in FIG. 5 so as to distinguish them from the other steps of method 500 and 600.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An automatic bin lid opener system comprising:

a bin top closure comprising a lid first portion, a lid second portion, and a hinge, wherein said lid first portion is nonremovably attached to a top opening of a storage bin and said lid second portion is pivotally attached to said lid first portion on one side via said hinge such that when said lid second portion is not in a parallel relationship with said lid first portion, an inner volume of said storage bin is able to be accessed, and when said lid second portion is in a parallel relationship with said lid first portion, said inner volume is sealed from an exterior environment;

a bin lid operator comprising an actuator, a telescopic cylinder having a first end and a second end, a swivel joint, a bail, and a programmable control box;

wherein said first end of said telescopic cylinder is attached to said swivel joint and said swivel joint is attached to a top exterior surface of said storage bin;

wherein said second end of said telescopic cylinder is pivotally attached to said bail, and said bail is attached to said lid second portion;

wherein said actuator is in communication with said telescopic cylinder such that said telescopic cylinder is able to pivot said lid second portion via an actuation of said actuator;

wherein said programmable control box is in communication with said actuator; and wherein said bin top closure is useful for remotely opening a top of a storage bin for filling said storage bin with said material and for aerating said material therein, and wherein said bin top closure is useful for remotely closing and sealing said storage bin thereafter to increase a safety of a user and to reduce a labor.

2. The automatic bin lid opener system of claim 1 wherein said programmable control box of said bin top closure is able to operate at least one said bin lid operator.

3. The automatic bin lid opener system of claim 2 wherein said programmable control box comprises a programmable time delay function.

4. The automatic bin lid opener system of claim 3 wherein said programmable control box is adapted to operate approximately six said bin lid operators independently.

5. The automatic bin lid opener system of claim 3 wherein said programmable control box is adapted to be operated remotely via a cell phone.

6. The automatic bin lid opener system of claim 2 wherein said programmable control box further comprises a manual bin lid operator switch.

7. The automatic bin lid opener system of claim 2 wherein said programmable control box comprises a plurality of electrical power cords each extending to an exterior of said programmable control box, each said electrical power cord having a quick coupler for coupling to a power cord for a corresponding said bin lid operator.

8. The automatic bin lid opener system of claim 1 wherein said programmable control box further comprises a plurality of exterior status indicators for indicating presence of power and wireless fidelity.

9. The automatic bin lid opener system of claim 1 wherein said bin lid operator is able to be attached to an existing storage bin lid.

10. The automatic bin lid opener system of claim 9 wherein said bin lid operator is adapted to pivotally open said lid second portion.

11. The automatic bin lid opener system of claim 9 wherein said bin lid operator is adapted to slide open said lid second portion.

12. The automatic bin lid opener system of claim 11 wherein said bin lid operator is adapted to operate a slide valve located on a bottom of said storage bin.

13. The automatic bin lid opener system of claim 9 wherein said bin lid operator is able to apply approximately 200 pounds of closing force.

14. The automatic bin lid opener system of claim 1 wherein said actuator is adapted to extend eight inches from a fully retracted position.

15. The automatic bin lid opener system of claim 1 wherein said swivel joint is adapted to freely rotate in four directions to compensate for misalignment.

16. The automatic bin lid opener system of claim 1 wherein said telescopic cylinder is adapted to have approximately six attachment points for adjusting a length of said telescopic cylinder to allow for a 90 degree opening of said lid second portion.

17. The automatic bin lid opener system of claim 1 wherein said manual bin lid operator switch is adapted to hold said lid second portion at any user preferred angle of opening.

18. The automatic bin lid opener system of claim 1 wherein said bail is structured and arranged to provide a mechanical advantage for said telescopic cylinder to pivotally operate said lid second portion.

19. An automatic bin lid opener system comprising:

a bin top closure comprising a lid first portion, a lid second portion, and a hinge, wherein said lid first portion is non-removably attached to a top opening of a storage bin and said lid second portion is pivotally attached to said lid first portion on one side via said hinge such that when said lid second portion is not in a parallel relationship with said lid first portion, an inner volume of said storage bin is able to be accessed, and when said lid second portion is in a parallel relationship with said lid first portion, said inner volume is sealed from an exterior environment, a bin lid operator comprising an actuator, a telescopic cylinder having a first end and a second end, a swivel joint, a bail, and a programmable control box;

wherein said bin lid operator is able to be attached to an existing storage bin lid;

wherein said first end of said telescopic cylinder is attached to said swivel joint and said swivel joint is attached to a top exterior surface of said storage bin;

wherein said swivel joint is adapted to freely rotate in 4 four directions to compensate for misalignment;

wherein said second end of said telescopic cylinder is pivotally attached to said bail and said bail is attached to said lid second portion;

wherein said bin lid operator is adapted to pivotally open said lid second portion;

wherein said bin lid operator is adapted to slide open said lid second portion;

wherein said bin lid operator is adapted to operate a slide valve located on a bottom of said storage bin;

wherein said bin lid operator is able to apply approximately 200 pounds of closing force;

wherein said telescopic cylinder is adapted to have approximately 6 six attachment points for adjusting a length of said telescopic cylinder to allow for a 90 degree opening of said lid second portion;

wherein said actuator is in communication with said telescopic cylinder such that said telescopic cylinder is able to pivot said lid second portion via an activation of said actuator;

wherein said actuator is adapted to extend eight inches from a fully retracted position;

wherein said programmable control box is in communication with said actuator;

wherein said programmable control box of said bin top closure is able to operate at least one said bin lid operator;

wherein said programmable control box is adapted to operate approximately six said bin lid operators independently;

wherein said programmable control box comprises a programmable time delay function;

wherein said programmable control box further comprises a manual bin lid operator switch;

wherein said manual bin lid operator switch is adapted to hold said lid second portion at any user preferred angle of opening;

wherein said programmable control box further comprises a plurality of exterior status indicators for indicating presence of power and wireless fidelity;

wherein said programmable control box is adapted to be operated remotely via a cell phone;

wherein said programmable control box comprises a plurality of electrical power cords each extending to an exterior of said programmable control box, each said electrical power cord having a quick coupler for coupling to a power cord for a corresponding said bin lid operator; and wherein said bin top closure is useful for remotely opening a top of a storage bin for filling said storage bin with said material and for aerating said material therein, and wherein said bin top closure is useful for remotely closing and sealing said storage in thereafter to increase a safety of a user and to reduce a labor.

20. The combination of an automatic bin lid opener system and a wireless fidelity system comprising:

a.) a bin top closure comprising;

a lid first portion, a lid second portion, and a hinge, wherein said lid first portion is non-removably attached to a top opening of a storage bin and said lid second portion is pivotally attached to said lid first portion on one side via said hinge such that when said lid second portion is not in a parallel relationship with said lid first portion, an inner volume of said storage bin is able to be accessed, and when said lid second portion is in a parallel relationship with said lid first portion, said inner volume is sealed from an exterior environment;

b.) a bin lid operator comprising;

an actuator, a telescopic cylinder having a first end and a second end, a swivel joint, a bail, and a programmable control box;

wherein said first end of said telescopic cylinder is attached to said swivel joint and said swivel joint is attached to a top exterior surface of said storage bin;

wherein said second end of said telescopic cylinder is pivotally attached to said bail, and said bail is attached to said lid second portion;

wherein said actuator is in communication with said telescopic cylinder such that said telescopic cylinder is able to pivot said lid second portion via said bail when said actuator is activated;

wherein said programmable control box is in communication with said actuator; and wherein said bin top closure is useful for opening a top of a storage bin from a ground level via said programmable control box for filling said storage bin with a material and for aerating said material therein, and wherein said bin top closure is useful for closing and sealing said storage bin thereafter from a ground level to increase a safety of a user and to reduce labor;

c.) a wireless fidelity system comprising;

a mobile station having;

a wireless transceiver;

a control unit; and an antenna system;

wherein said wireless transceiver is located within said programmable control box and adapted to receive a command from a cellular phone;

wherein said control unit is located within said programmable control box and adapted to receive a command from said wireless transceiver, said control unit in communication with said programmable control box;

wherein said antenna system is adapted to receive a wireless cellular command signal from a cell phone; and wherein said wireless fidelity system is useful for adjusting a degree angle of opening of said lid second portion from a remote location via said cell phone.

* * * * *